US012351285B2

(12) United States Patent
Wan et al.

(10) Patent No.: US 12,351,285 B2
(45) Date of Patent: Jul. 8, 2025

(54) ATTITUDE ADJUSTMENT APPARATUS FOR SELF-PROPELLED BIO-INSPIRED ROBOTIC FISH

(71) Applicant: South China University of Technology, Guangzhou (CN)

(72) Inventors: Zhenping Wan, Guangzhou (CN); Jiahao Yu, Guangzhou (CN); Xuesong Hu, Guangzhou (CN); Guangquan Huang, Guangzhou (CN); Guanyuan Huang, Guangzhou (CN); Hang Zhao, Guangzhou (CN); Liujie Dong, Guangzhou (CN); Zhao Luo, Guangzhou (CN)

(73) Assignee: South China University of Technology, Guangzhou (CN)

( * ) Notice: Subject to any disclaimer, the term of this patent is extended or adjusted under 35 U.S.C. 154(b) by 546 days.

(21) Appl. No.: 17/811,299

(22) Filed: Jul. 7, 2022

(65) Prior Publication Data

US 2023/0013643 A1 Jan. 19, 2023

(51) Int. Cl.
*B63G 8/22* (2006.01)
*B63H 1/36* (2006.01)

(52) U.S. Cl.
CPC . *B63G 8/22* (2013.01); *B63H 1/36* (2013.01)

(58) Field of Classification Search
CPC ... B63G 8/00; B63G 8/14; B63G 8/22; B63G 8/26; B63H 1/36; B63C 11/52
USPC ..... 114/313, 317, 330, 333
See application file for complete search history.

(56) References Cited

U.S. PATENT DOCUMENTS

| | | | | |
|---|---|---|---|---|
| 4,832,650 | A * | 5/1989 | Tong | A63H 23/14 446/156 |
| 6,854,412 | B1 | 2/2005 | Courson et al. | |
| 9,090,320 | B2 * | 7/2015 | Rufo | F16F 3/00 |
| 9,701,380 | B2 * | 7/2017 | Lu | A63H 23/14 |
| 9,937,986 | B1 * | 4/2018 | Oh | B63G 8/001 |
| 10,107,078 | B2 | 10/2018 | Taylor et al. | |
| 10,370,074 | B2 | 8/2019 | Byrd et al. | |
| 11,192,619 | B2 * | 12/2021 | Yao | B63H 1/36 |

FOREIGN PATENT DOCUMENTS

| | | |
|---|---|---|
| CN | 207607626 U | 7/2018 |
| CN | 111846164 A | 10/2020 |

* cited by examiner

*Primary Examiner* — Daniel V Venne
(74) *Attorney, Agent, or Firm* — True Shepherd LLC; Andrew C. Cheng

(57) ABSTRACT

An attitude adjustment apparatus for a self-propelled bio-inspired robotic fish includes a fish body, where the fish body includes: a housing; a center-of-gravity adjustment assembly, located in the housing to adjust a center of gravity of the fish body, and including at least one counterweight and a screw-slider mechanism that drives the counterweight to move in a head-to-tail direction; and a suction and drainage system, located in the housing to adjust a weight of the fish body, and including a ballast tank and a water control assembly for controlling a water level in the ballast tank. The center-of-gravity adjustment assembly is combined with the suction and drainage system to rapidly change the weight and center of gravity of the fish body, so as to quickly adjust the pitching attitude and heaving state of the robotic fish.

9 Claims, 6 Drawing Sheets

ATTITUDE ADJUSTMENT APPARATUS FOR SELF-PROPELLED BIO-INSPIRED ROBOTIC FISH

CROSS-REFERENCE TO RELATED APPLICATIONS

This application claims priority to Chinese Patent Application No. 202110808128.0 with a filing date of Jul. 16, 2021. The content of the aforementioned application, including any intervening amendments thereto, is incorporated herein by reference.

TECHNICAL FIELD

The present disclosure relates to the technical field of bio-inspired robotic fish, and in particular to an attitude adjustment apparatus for a self-propelled bio-inspired robotic fish.

BACKGROUND ART

In order to explore the deep water field, people gradually turn their attention to the development of marine engineering, which promotes the development of submersibles. However, uncertainties and unpredictable hazards in the ocean (water disturbances, ocean currents, high pressure, low visibility, etc.) constrain the work of scientific researchers and engineers.

As the oldest vertebrates living in water, fish can swim flexibly and quickly in water after a long period of evolution and natural selection. Fish can quickly adjust their attitude in the water, including rising, sinking, tilt with head down, and tilt with tail down. The researchers hope to learn the high propulsion efficiency and flexible movement mechanism of fish through biomimetic research on fish. In recent years, with the design and manufacture of various bio-inspired robotic fish, the research on bio-inspired robotic fish has entered a new period.

The tail of the traditional robotic fish is driven by a single motor to swing back and forth, but the motor utilization is low, and the attitude adjustment effect is not desired. The attitude adjustment systems of most of the existing robotic fish have the problems of unreliability, slow response, poor flexibility and difficult control, and there is still a big gap with the attitude adjustment effect of real fish.

SUMMARY

The present disclosure is intended to solve most if not all of the above-mentioned technical problems in the prior art. To this end, an embodiment of the present disclosure provides an attitude adjustment apparatus for a self-propelled bio-inspired robotic fish, which can quickly adjust the underwater attitude of the robotic fish.

According to the embodiment of the present disclosure, the attitude adjustment apparatus for a self-propelled bio-inspired robotic fish includes a fish body, where the fish body includes: a housing; a center-of-gravity adjustment assembly, located in the housing to adjust a center of gravity of the fish body, and including at least one counterweight and a screw-slider mechanism that drives the counterweight to move in a head-to-tail direction; and a suction and drainage system, located in the housing to adjust a weight of the fish body, and including a ballast tank and a water control assembly for controlling a water level in the ballast tank.

According to an optional or preferable embodiment, the screw-slider mechanism may include a fixed seat fixed in the housing, a slide rail fixed to the fixed seat, a mover movable along the slide rail, a screw rod connected to the mover, and a stepping motor for driving the screw rod to rotate; the counterweight may be fixed to the mover; the mover may be provided with a slider that may be matched with the slide rail and slidable along the slide rail; and the mover may be provided with a screw hole matched with the screw rod, such that the screw rod may be rotated to drive the mover to move, so as to change a position of the counterweight in the fish body.

According to an optional or preferable embodiment, the mover may be provided with a counterweight holder, and the counterweight may be held by the counterweight holder.

According to an optional or preferable embodiment, the fixed seat may be provided with a first limit switch and a second limit switch; and the counterweight holder may be provided with a first limit guard matched with the first limit switch and a second limit guard matched with the second limit switch, so as to control a stroke of the mover.

According to an optional or preferable embodiment, the water control assembly may include a water pump provided with a water suction pipe and a water outlet pipe; the water outlet pipe of the water pump may be connected to the ballast tank to feed water into the ballast tank; the ballast tank may be connected to a drain pipe to drain water in the ballast tank; and the drain pipe may be provided with a one-way valve.

According to an optional or preferable embodiment, the ballast tank may include a rear tank body and a front end cover, which may be in sealed connection to form a chamber inside the ballast tank.

According to an optional or preferable embodiment, the front end cover may be provided with a water inlet port and a drain port; the drain pipe may be connected to the drain port; and the water outlet pipe of the water pump may be connected to the water inlet port.

According to an optional or preferable embodiment, the housing may include a head portion, a trunk portion and a tail portion which may be connected in sequence; the center-of-gravity adjustment assembly may be located within the head portion; a head base may be provided between the head portion and the trunk portion; the water pump may be provided at a head end of the head base; and the trunk portion may include the ballast tank and a trunk housing connected to the ballast tank.

According to an optional or preferable embodiment, the head base may be provided with a water suction joint and a water outlet joint; the water suction pipe of the water pump passes through the water suction joint to contact with water; and the water outlet pipe of the water pump passes through the water outlet joint to connect the water inlet port.

Based on the above technical solution, the embodiment of the present disclosure has at least the following beneficial effects. By designing the center-of-gravity adjustment assembly and controlling the position change of the counterweight in the fish body, the embodiment of the present disclosure can adjust the center of gravity of the fish body, thereby changing the pitching attitude of the robotic fish. By designing the suction and drainage system and controlling the water level in the ballast tank, the embodiment of the present disclosure can quickly adjust the heaving state of the robotic fish. The embodiment of the present disclosure combines the center-of-gravity adjustment assembly with the suction and drainage system to rapidly change the weight and center of gravity of the fish body, and quickly adjust the pitching attitude and heaving state of the robotic fish. In this way, the present disclosure realizes the locomotion function of the robotic fish, that is, diving and ascending underwater efficiently and flexibly.

BRIEF DESCRIPTION OF THE DRAWINGS

The present disclosure is described in further detail below with reference to the drawings and embodiments.

DETAILED DESCRIPTION OF THE EMBODIMENTS

Figure 1:
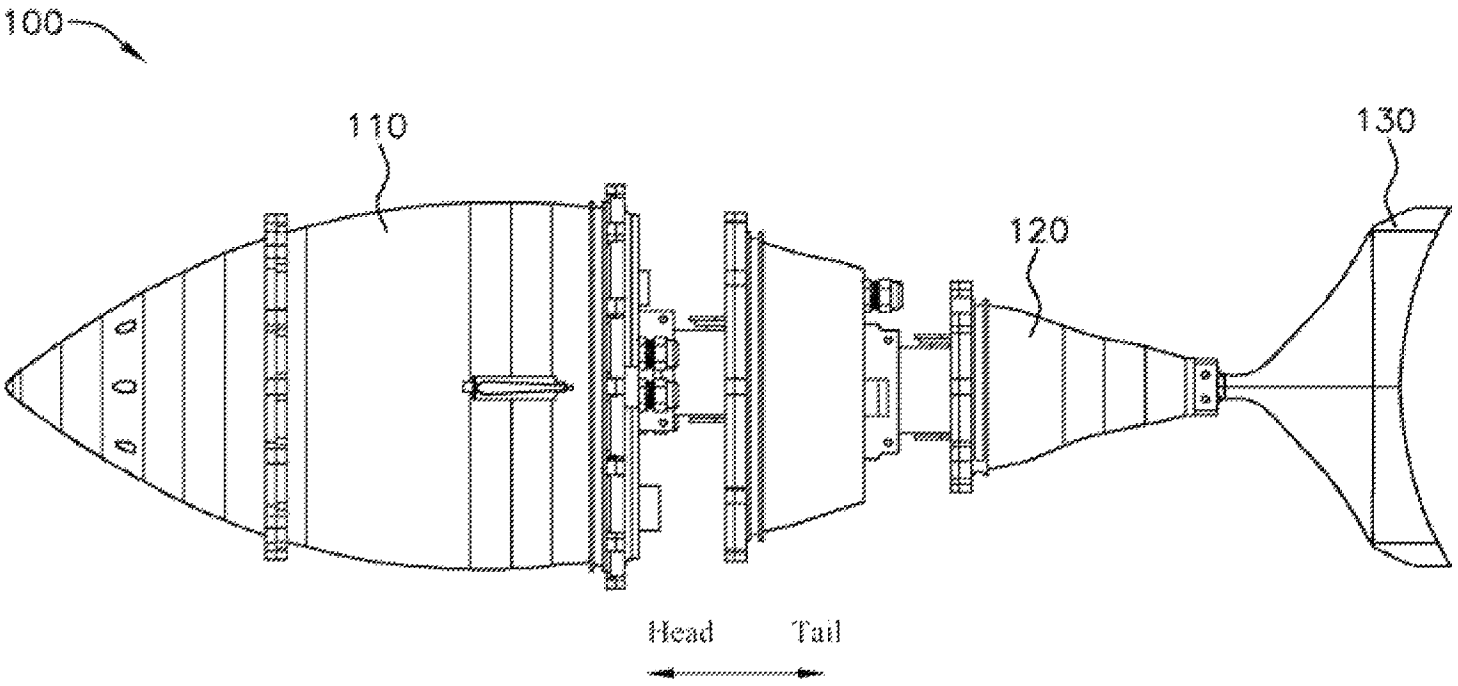
FIG. 1 is a structural view of an attitude adjustment apparatus for a self-propelled bio-inspired robotic fish according to an embodiment of the present disclosure.

The specific embodiments of the present disclosure will be described in detail below. The preferred embodiments of the present disclosure are shown in the drawings. The drawings are intended to supplement the description of the textual part of the specification with graphics, so as to make the technical features and overall technical solution of the present disclosure vividly understood. However, these drawings should not be understood as a limitation to the protection scope of the present disclosure.

It should be understood that, in the description of the present disclosure, the orientation or position relationships indicated by terms such as "upper", "lower", "front", "rear", "left" and "right" are shown in the drawings. These terms are merely intended to facilitate and simplify the description of the present disclosure, rather than to indicate or imply that the mentioned apparatus or components must have a specific orientation or must be constructed and operated in a specific orientation. Therefore, these terms should not be understood as a limitation to the present disclosure.

In the description of the present disclosure, "several" means one or more than one, while "multiple" means more than two; "larger than", "smaller than" and "over" exclude the mentioned number, while "above", "below" and "within" include the mentioned number. The "first" and "second" in the description are merely intended to distinguish technical features, rather than to indicate or imply relative importance or implicitly indicate a number of the indicated technical features or implicitly indicate a sequence relationship of the indicated technical features.

In the description of the present disclosure, unless otherwise explicitly defined, the terms such as "arrange", "mount" and "connect" should be understood in a broad sense, and those skilled in the technical field can reasonably determine the specific meanings of these terms in the present disclosure in combination with the specific content of the technical solutions.

Referring to FIGS. 1 to 6, an attitude adjustment apparatus for a self-propelled bio-inspired robotic fish includes a fish body. The fish body includes a housing 100, a center-of-gravity adjustment assembly 200, and a suction and drainage system 300. Specifically, as shown in FIG. 1, the housing 100 includes a head portion 110, a trunk portion 120 and a tail portion 130 which are connected in sequence. The tail portion 130 is flexible.

Figure 2:
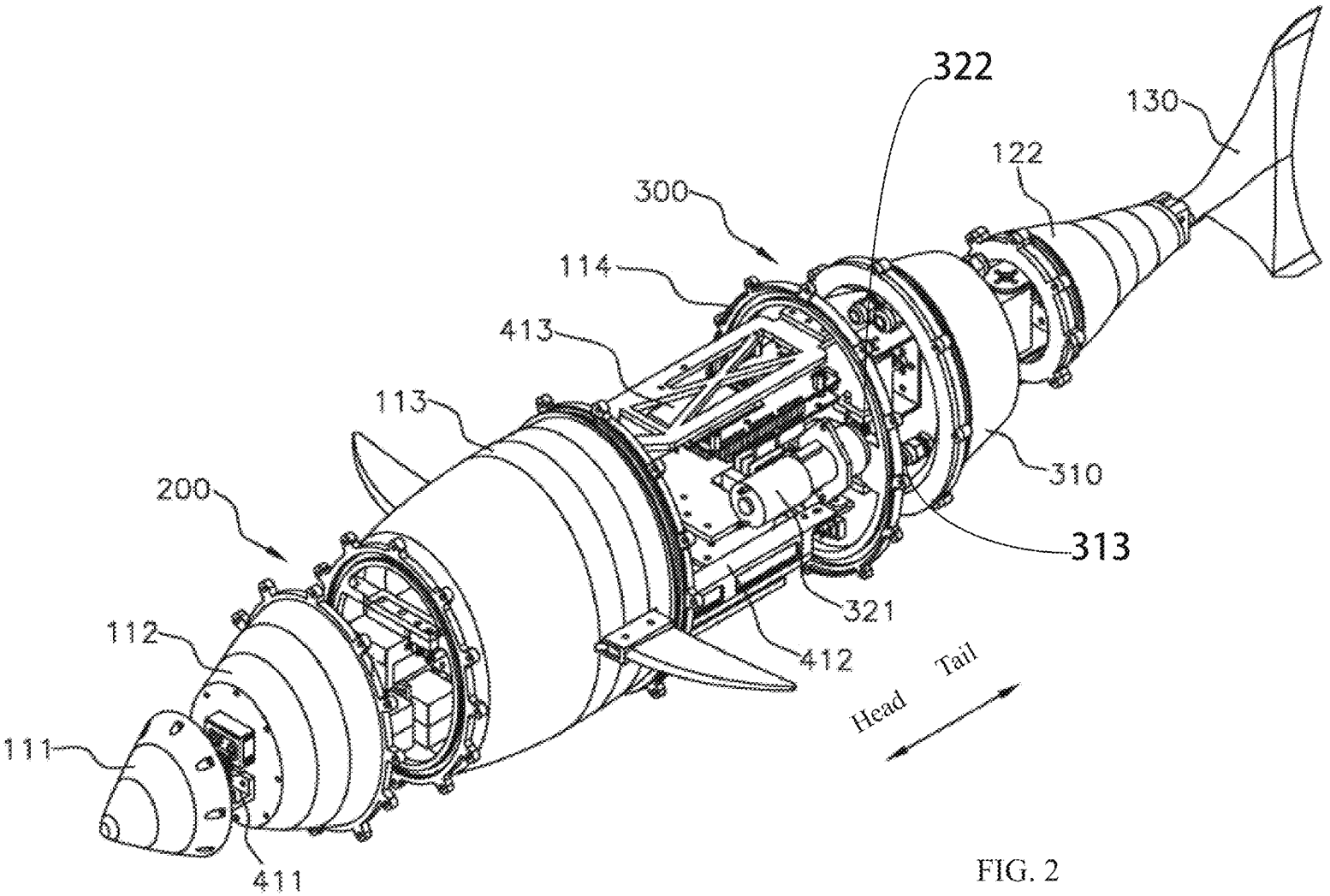
FIG. 2 is an exploded view of the attitude adjustment apparatus for a self-propelled bio-inspired robotic fish according to an embodiment of the present disclosure.
Figure 3:
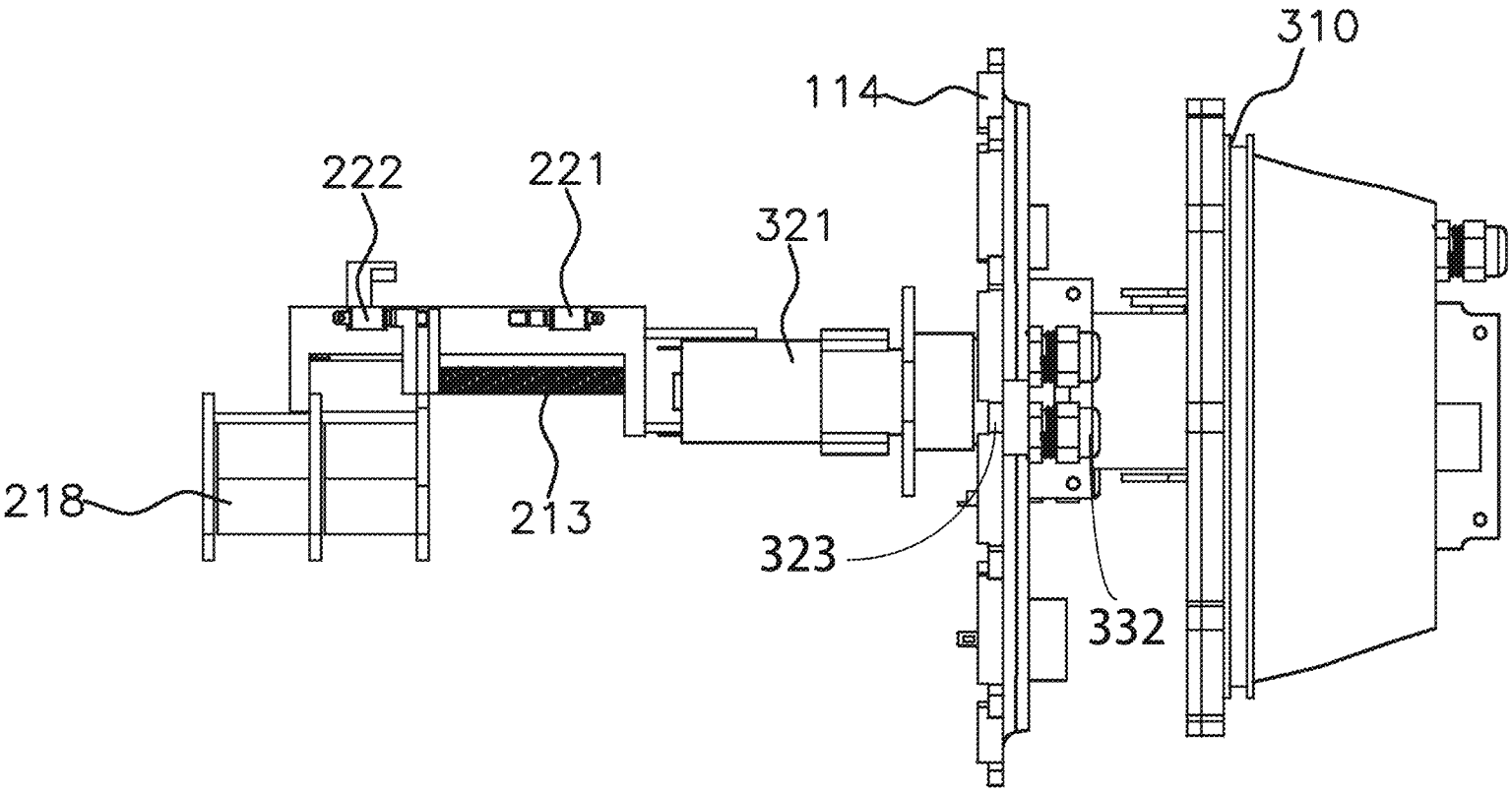
FIG. 3 is a structural view of a center-of-gravity adjustment assembly and a suction and drainage system of the attitude adjustment apparatus according to the present disclosure.
Figure 4:
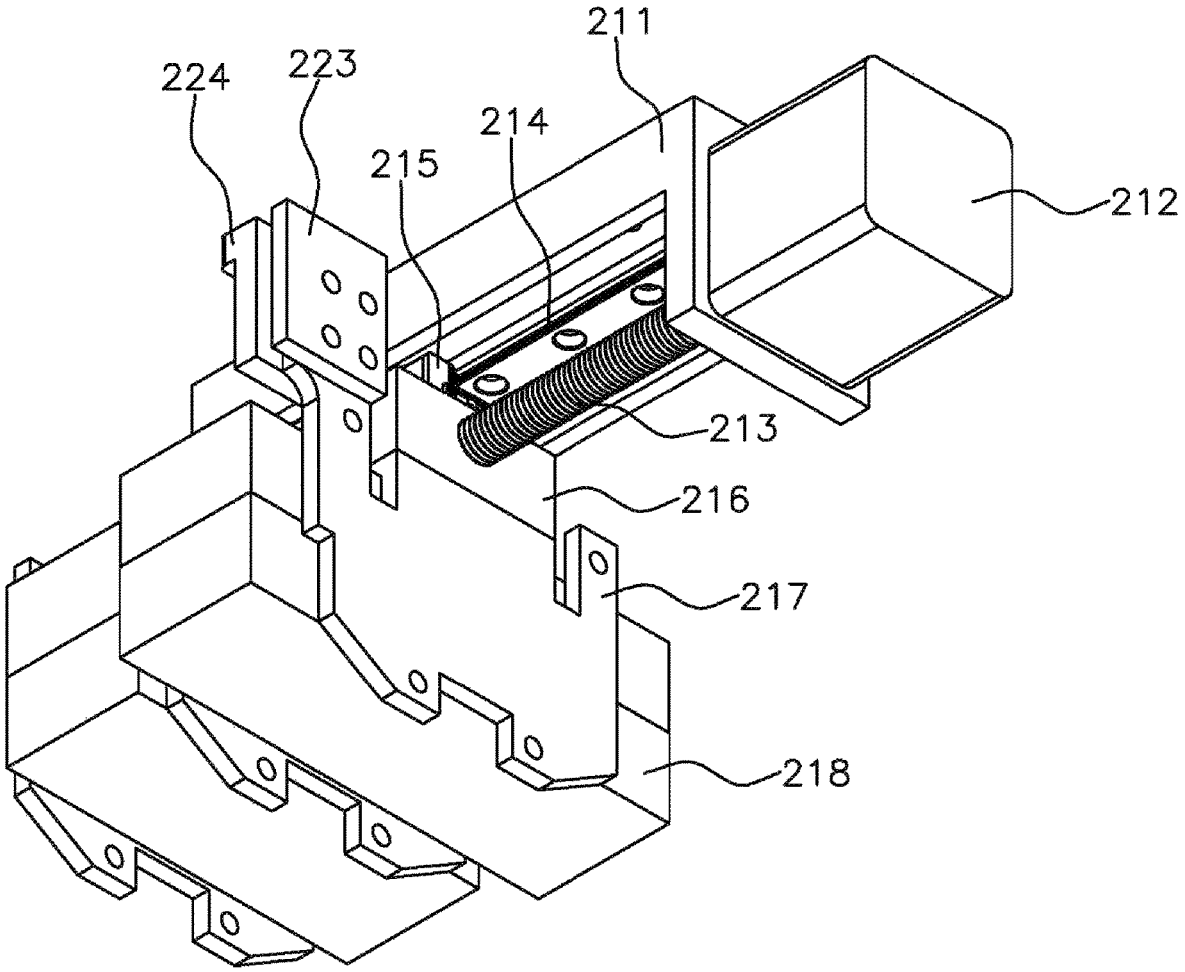
FIG. 4 is a perspective view of the center-of-gravity adjustment assembly according to an embodiment of the present disclosure.

The center-of-gravity adjustment assembly 200 is located in the housing 100 to adjust a center of gravity of the fish body. Specifically, the center-of-gravity adjustment assembly 200 is located within the head portion 110. Referring to FIG. 2, the head portion 110 includes a first head housing 111, a second head housing 112 and a third head housing 113 which are connected in sequence. A camera module 411 is provided at one side in a head of the second head housing 112, and is connected to the first head housing 112. In this embodiment, the center-of-gravity adjustment assembly 200 is provided in the third head housing 113, and multiple beams for mounting the center-of-gravity adjustment assembly 200 are arranged in the third head housing 113.

In this embodiment, the center-of-gravity adjustment assembly 200 includes at least one counterweight 218 and a screw-slider mechanism that drives the counterweight 218 to move in a head-to-tail direction. The center of gravity of the fish body is adjusted by controlling a position change of the counterweight 218 in the fish body, thereby changing a pitching attitude of the robotic fish.

Specifically, the screw-slider mechanism includes a fixed seat 211 fixed in the housing 100, a slide rail 214 fixed to the fixed seat 211, a mover 216 movable along the slide rail 214, a screw rod 213 connected to the mover 216, and a stepping motor 212 for driving the screw rod 213 to rotate. The counterweight 218 is fixed to the mover 216. The mover 216 is provided with a slider 215 that is matched with the slide rail 214 and slidable along the slide rail 214. The mover 216 is provided with a screw hole matched with the screw rod 213, such that the screw rod 213 is rotated to drive the mover 216 to move, so as to change the position of the counterweight 218 in the fish body. In addition, the mover 216 is provided with a counterweight holder 217. The counterweight 218 is held by the counterweight holder 217.

Preferably, it is necessary to avoid excessive movement of the mover 216 on the screw rod 213 so as to avoid collision with two walls of the fixed seat during the movement. To this end, the fixed seat 211 is provided with a first limit switch 221 and a second limit switch 222. The counterweight holder 217 is provided with a first limit guard 223 matched with the first limit switch 221 and a second limit guard 224 matched with the second limit switch 222, so as to control a stroke of the mover 216.

The suction and drainage system 300 is located in the housing 100 to adjust a weight of the fish body. The suction and drainage system 300 includes a ballast tank 310 and a water control assembly for controlling a water level in the ballast tank 310. The heaving state of the robotic fish is quickly adjusted by controlling the water level in the ballast tank 310.

A power module 412 and an integrated circuit control module 413 are further arranged in the third head housing 113. The power module 412 supplies power to each component, and the integrated circuit control module 413 controls the operation of each component.

Figure 6:
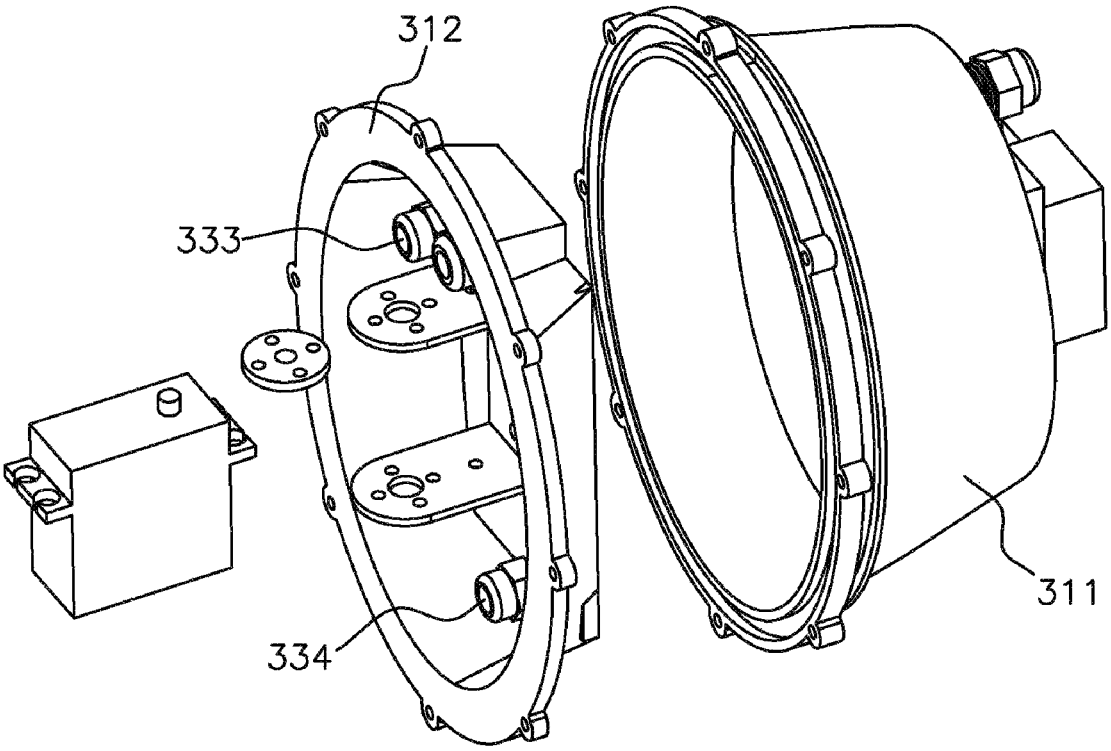
FIG. 6 is a perspective view of the suction and drainage system according to an embodiment of the present disclosure.

Specifically, the water control assembly in the suction and drainage system 300 includes a water pump 321 provided with a water suction pipe 322 and a water outlet pipe 323. The water outlet pipe 323 of the water pump 321 is connected to the ballast tank 310 to feed water into the ballast tank 310. The ballast tank 310 is connected to a drain pipe 313 to drain water in the ballast tank 310. The drain pipe 313 is provided with a one-way valve. As shown in FIG. 6, the ballast tank 310 includes a rear tank body 311 and a front end cover 312 in sealed connection to the rear tank body 311. The front end cover 312 is connected to the rear tank body 311 to form a chamber inside the ballast tank 310. By controlling the water level in the chamber, the weight of the fish body can be changed. The front end cover 312 and the rear tank body 311 are connected by screws, and a groove for accommodating an O-ring seal is provided between their contact surfaces.

In addition, the front end cover 312 is provided with a water inlet port 333 and a drain port 334. The drain pipe 313 is connected to the drain port 334, and the water outlet pipe 323 of the water pump 321 is connected to the water inlet port 333. A head base 114 is provided between the head portion 110 and the trunk portion 120. The water pump 321 is provided at a head end of the head base 114. The trunk portion 120 includes the ballast tank 310 and a trunk housing 122 connected to the ballast tank 310. The head base 114 is provided with multiple access holes, including a program line access hole, a power module charging hole, a power switch hole, etc., which will not be described in detail herein.

Figure 5:
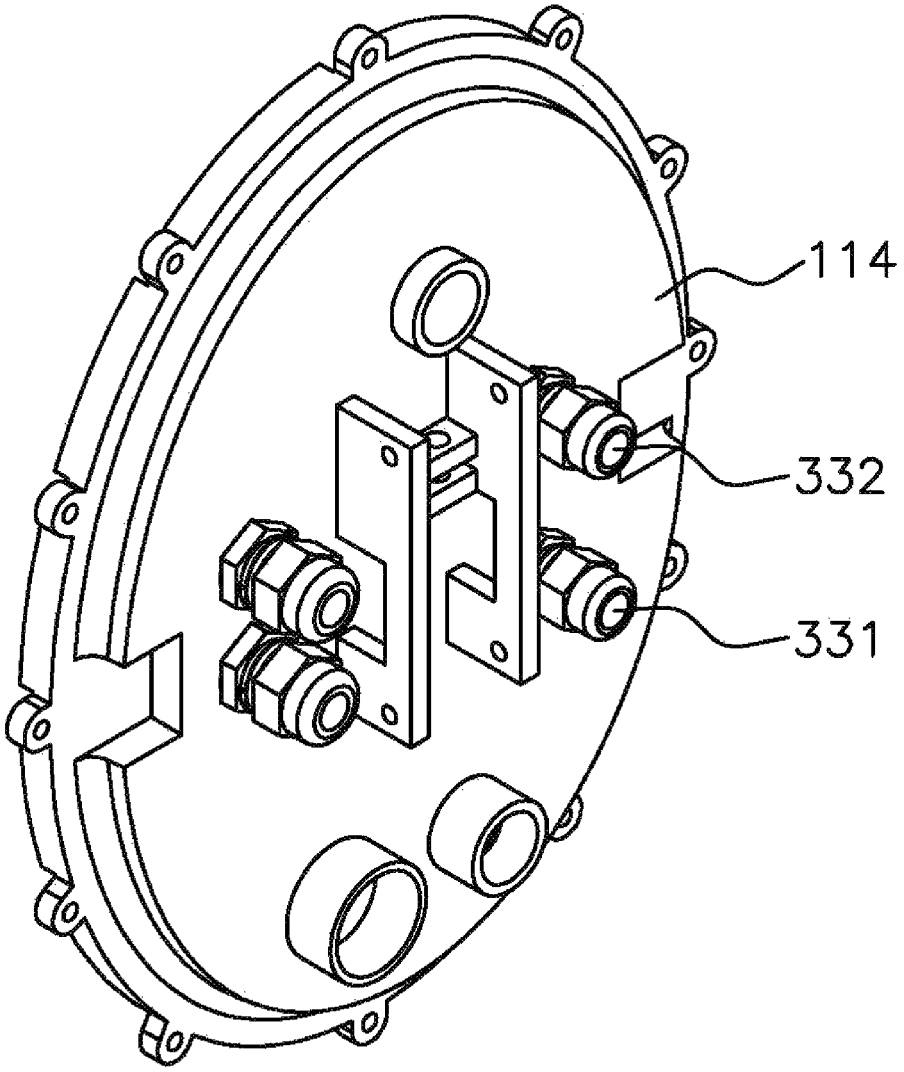
FIG. 5 is a perspective view of a head base according to an embodiment of the present disclosure.

As shown in FIG. 5, the head base 114 is provided with a water suction joint 331 and a water outlet joint 332. The water suction pipe 322 of the water pump 321 passes through the water suction joint 331 to contact with water. The water outlet pipe 323 of the water pump 321 passes through the water outlet joint 332 to connect the water inlet port 333.

It is understandable that one end of the water suction pipe 322 of the water pump 321 passes through the water suction joint 331 and is in contact with the water, and the water pump 321 absorbs water through the end of the water suction pipe 322. One end of the water outlet pipe 323 of the water pump 321 passes through the water outlet joint 332 to be connected to the water inlet port 333 and the interior of the ballast tank 310, and the water pump 321 conveys the water to the chamber in the ballast tank 310 through this end of the water outlet pipe 323. The drain port 334 is connected to the drain pipe 313 provided with the one-way valve to drain the water in the ballast tank 310. The suction and drainage system 300 absorbs water for and drains water from the ballast tank 310 through the water pump 321, and controls the water level in the ballast tank 310 to change the weight of the robotic fish and quickly adjust the heaving state of the robotic fish.

The embodiment of the present disclosure combines the center-of-gravity adjustment assembly 200 with the suction and drainage system 300 to rapidly change the weight and center of gravity of the fish body, so as to quickly adjust the pitching attitude and heaving state of the robotic fish. In this way, the present disclosure realizes the locomotion function of the robotic fish, that is, diving and ascending underwater efficiently and flexibly. The attitude adjustment apparatus of the present disclosure can be combined with the swing motion of the tail portion of the bio-inspired robotic fish, so as to control the robotic fish to perform efficiently motorized, complex underwater three-dimensional motion.

The embodiments of the present disclosure are described in detail above with reference to the drawings, but the present disclosure is not limited thereto. Those of ordinary skill in the technical field can make various changes to the embodiments of the present disclosure without departing from the purpose of the present disclosure.

What is claimed is:

1. An attitude adjustment apparatus for a self-propelled bio-inspired robotic fish, comprising a fish body, wherein the fish body comprises:

a housing (100);

a center-of-gravity adjustment assembly (200), located in the housing (100) to adjust a center of gravity of the fish body, and comprising at least one counterweight (218) and a screw-slider mechanism that drives the at least one counterweight (218) to move in a head-to-tail direction; and a suction and drainage system (300), located in the housing (100) to adjust a weight of the fish body, and comprising a ballast tank (310) and a water control assembly for controlling a water level in the ballast tank (310).

2. The attitude adjustment apparatus according to claim 1, wherein the screw-slider mechanism comprises a fixed seat (211) fixed in the housing (100), a slide rail (214) fixed to the fixed seat (211), a mover (216) movable along the slide rail (214), a screw rod (213) connected to the mover (216), and a stepping motor (212) for driving the screw rod (213) to rotate; the at least one counterweight (218) is fixed to the mover (216); the mover (216) is provided with a slider (215) that is matched with the slide rail (214) and slidable along the slide rail (214); and the mover (216) is provided with a screw hole matched with the screw rod (213), such that the screw rod (213) is rotated to drive the mover (216) to move, so as to change a position of the at least one counterweight (218) in the fish body.

3. The attitude adjustment apparatus according to claim 2, wherein the mover (216) is provided with a counterweight holder (217), and the at least one counterweight (218) is held by the at least one counterweight holder (217).

4. The attitude adjustment apparatus according to claim 3, wherein the fixed seat (211) is provided with a first limit switch (221) and a second limit switch (222); and the at least one counterweight holder (217) is provided with a first limit guard (223) matched with the first limit switch (221) and a second limit guard (224) matched with the second limit switch (222), so as to control a stroke of the mover (216).

5. The attitude adjustment apparatus according to claim 1, wherein the water control assembly comprises a water pump (321) provided with a water suction pipe and a water outlet pipe; the water outlet pipe of the water pump (321) is connected to the ballast tank (310) to feed water into the ballast tank (310); the ballast tank (310) is connected to a drain pipe to drain water in the ballast tank (310).

6. The attitude adjustment apparatus according to claim 5, wherein the ballast tank (310) comprises a rear tank body (311) and a front end cover (312), which are in sealed connection to form a chamber inside the ballast tank (310).

7. The attitude adjustment apparatus according to claim 6, wherein the front end cover (312) is provided with a water inlet port (333) and a drain port (334); the drain pipe is connected to the drain port (334); and the water outlet pipe of the water pump (321) is connected to the water inlet port (333).

8. The attitude adjustment apparatus according to claim 7, wherein the housing (100) comprises a head portion (110), a trunk portion (120) and a tail portion (130) which are connected in sequence; the center-of-gravity adjustment assembly (200) is located within the head portion (110); a head base (114) is provided between the head portion (110)

and the trunk portion (120); the water pump (321) is provided at a head end of the head base (114);

and the trunk portion (120) comprises the ballast tank (310) and a trunk housing (122) connected to the ballast tank (310).

9. The attitude adjustment apparatus according to claim 8, wherein the head base (114) is provided with a water suction joint (331) and a water outlet joint (332); the water suction pipe of the water pump (321) passes through the water suction joint (331) to contact with water; and the water outlet pipe of the water pump (321) passes through the water outlet joint (332) to connect the water inlet port (333).

* * * * *